US007611388B1

(12) United States Patent
Lee

(10) Patent No.: US 7,611,388 B1
(45) Date of Patent: Nov. 3, 2009

(54) ELECTRICITY ACQUIRING PLUG USED IN VEHICLE

(76) Inventor: Ching-Chuan Lee, 6F-3, No. 123, Lane 235, Baociao Rd., Sindian-city, Taipei Country (TW)

( * ) Notice: Subject to any disclaimer, the term of this patent is extended or adjusted under 35 U.S.C. 154(b) by 0 days.

(21) Appl. No.: 12/426,874

(22) Filed: Apr. 20, 2009

(51) Int. Cl.
*H01R 24/04* (2006.01)

(52) U.S. Cl. ..... 439/668

(58) Field of Classification Search ..... 439/668, 439/352, 358

See application file for complete search history.

(56) References Cited

U.S. PATENT DOCUMENTS 4,054,352 A * 10/1977 Rudin ..... 439/304
4,109,988 A * 8/1978 Olson ..... 439/265
5,569,053 A * 10/1996 Nelson et al. ..... 439/668
5,626,496 A * 5/1997 Hahn ..... 439/668

* cited by examiner

*Primary Examiner*—Phuong K Dinh
(74) *Attorney, Agent, or Firm*—Guice Patents PLLC

(57) ABSTRACT

The present invention relates to an electricity acquiring plug used in vehicle, a hollow main body is provided with an electrode connecting set, a sliding member and a passive member, and a releasing ring is provided at a rear portion of the main body. The electrode connecting set is provided with a power connecting electrode and two ground connecting electrode respectively at a front end and two lateral ends of the main body, when two connecting sheets provided at the front end of the main body are inwardly retracted due to an external force, beveled surfaces of a pair of pushing rods are inwardly moved and a pair of connecting arms of the passive member are outwardly expanded, so inner walls of a pair of fastening sheets of the main body are outwardly expanded through the pair of connecting arms, a fastening status is therefore obtained; when the releasing ring provided at the rear portion of the main body is backwardly pulled, the linking section of the passive member is pushed by the connecting ring of the releasing ring, so the passive member is backwardly moved, and the fastening sheets are no longer pressed and inwardly retracted so the fastening status is released. So the connection of the electricity acquiring plug for vehicle and a socket can be avoided from being overly tight or overly loose and a rapid releasing function is achieved.

9 Claims, 6 Drawing Sheets

ELECTRICITY ACQUIRING PLUG USED IN VEHICLE

BACKGROUND OF THE INVENTION

1. Field of the Invention

The present invention relates to an electricity acquiring plug used in vehicle, more particularly to an electricity acquiring plug used in vehicle having auto fastening and rapid releasing functions.

2. Description of Related Art

A plug for lighting cigarette is often provided at a front panel of a vehicle, the round plug is a plug with 12V or 24V DC power. A conventional means is that a cigarette lighter is inserted in the cigarette-lighting plug; because said means involves a process of converting electrical energy into thermal energy so a high resistance value is generated, a fuse is often installed for providing a power breaking off function caused by over heating.

As for various portable electronic products have been developed, e.g. portable computers, mobile phones, personal digital assistant (PDA) and global positioning system (GPS), the cigarette-lighting plug (hereinafter referred as electricity acquiring plug for vehicle) is greatly adopted relative to the above mentioned electronic products. A power connecting electrode is extended from the center of a front end of a conventional electricity acquiring plug for vehicle and two lateral ends thereof respectively has a grounding connecting electrode with outward expanding resilient sheet, the rest part thereof is made of insulation materials; after the electricity acquiring plug for vehicle is inserted into an electricity acquiring socket, a guiding wire is used for outputting DC power so as to connect to the above mentioned portable electronic products.

For utilizing an electricity acquiring plug for vehicle available in a marketplace in a high current status, a means of increasing elastic forces of grounding and power connecting electrodes is often adopted, so each connecting electrode is ensured to have a sufficient connecting pressure. Said means would require a larger force for plugging or releasing the electricity acquiring plug for vehicle from an electricity acquiring socket; if the elastic force of the ground connecting electrode is overly high, the socket may be accidentally removed during an operation of releasing the electricity acquiring plug for vehicle.

Moreover, if the elastic force of the ground connecting electrode is not larger enough, connecting points of the power connecting electrode and the socket may be loosen because of vibration generated during driving the vehicle, so an inadequate connection may be generated and temperatures of the power connecting electrode and the connecting points are raised and the plastic housing may therefore melts, thus a fire may be occurred and a safety issue shall be concerned.

SUMMARY OF THE INVENTION

One object of the present invention is to provide an electricity acquiring plug used in vehicle having auto fastening and rapid releasing functions relative to an electricity acquiring socket, so the connection between the electricity acquiring plug used in vehicle and the socket is prevented from being overly-tight or overly-loose, the safety of using the electricity acquiring plug used in vehicle is therefore greatly increased.

For achieving the object mentioned above, one solution provided by the present invention is to provide an electricity acquiring plug used in vehicle, comprises:

a hollow main body, an electrode connecting set is installed inside the main body and the electrode connecting set is installed with a power connecting electrode and two ground connecting electrodes respectively at a front end and two lateral ends of the main body, the power and the ground connecting electrodes are respectively coupled to guiding wires of a power cable, the power cable is extended from the rear end of the main body, wherein a pair of fastening sheets and at least one through hole are respectively provided to a front and a rear portions of the main body in a radial direction;

a sliding member, two connecting sheets and two pushing rods are respectively installed at a front and a rear ends of the sliding member, the pair of connecting sheets protrude from the front end of the main body, the power connecting electrode is disposed between the two connecting sheets, the two push rods are respectively provided with a beveled surface, and a first spring is installed between the sliding member and the interior of the main body;

a passive member, two connecting arms provided adjacent to the beveled surfaces at the outer ends of the pushing rods are extended from the front end of the passive member, and a free end of each of the connecting arms is provided adjacent to the fastening sheets, and at least one linking section protruding from the through hole is radially provided on the passive member, a second spring is installed between the passive member and the interior of the main body; and a releasing ring, provided at the rear portion of the main body, a connecting ring whose inner end is adjacent to the linking section is protrudingly provided on the inner wall of the releasing ring;

when the two connecting sheets provided at the front end of the main body are inwardly retracted due to an external force, the beveled surfaces of the pair of pushing rods are inwardly moved and the pair of connecting arms of the passive member are outwardly expanded, so inner walls of the pair of fastening sheets of the main body are outwardly expanded through the pair of connecting arms, a fastening status is therefore obtained; when the releasing ring provided at the rear portion of the main body is backwardly pulled, the linking section of the passive member is pushed by the connecting ring of the releasing ring, so the passive member is backwardly moved, and the fastening sheets are no longer pressed and inwardly retracted so the fastening status is released.

DETAILED DESCRIPTION OF THE PREFERRED EMBODIMENT

Figure 1:
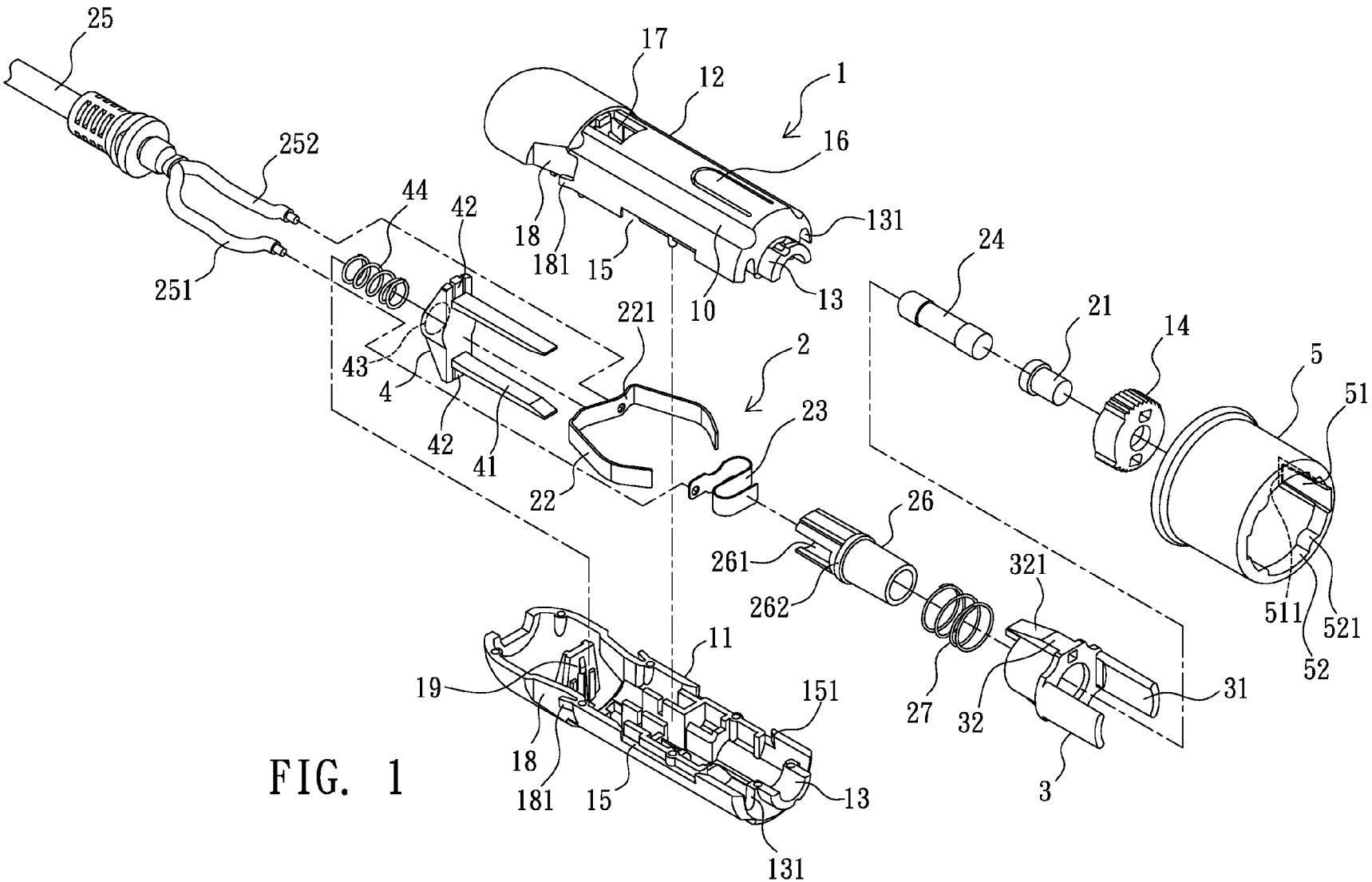
FIG. 1 is a 3D exploded view of the electricity acquiring plug for vehicle provided by the present invention.
Figure 2:
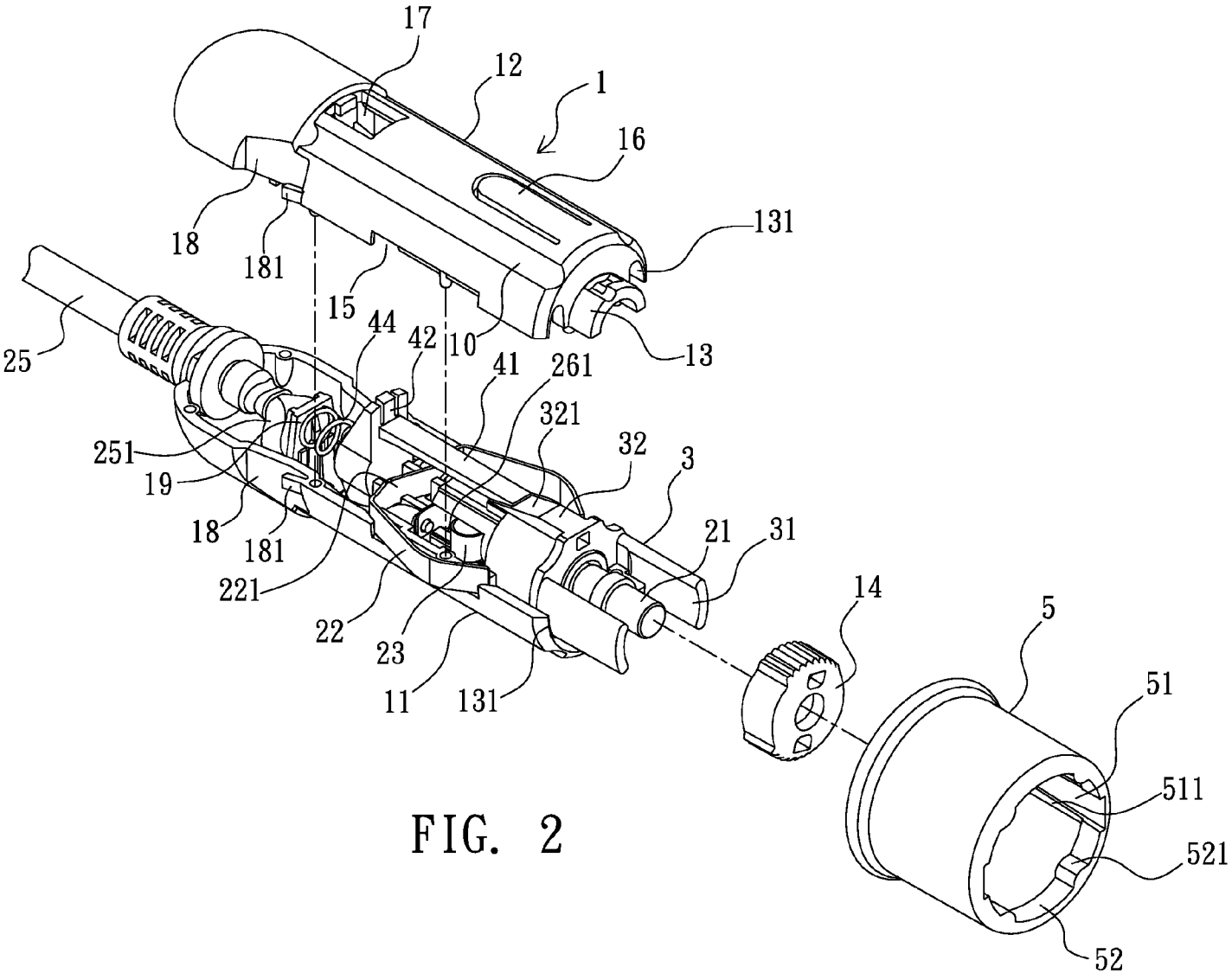
FIG. 2 is 3D view illustrating the assembly of the present invention before being assembled with the top cover, the end cover and the releasing ring.

As shown from FIG. 1 to FIG. 4*b*, the electricity acquiring plug for vehicle provided by the present invention is composed by a main body 1, an electrode connecting set 2, a sliding member 3, a passive member 4 and a releasing ring 5.

The main body 1 is composed by a bottom cover 11 and a top cover 12 being engaged to each other, a column ring 13 provided at a front end of the main body 1 is connected to an end cover 14, so a power connecting electrode 21 of the electrode connecting set 2 is able to protrude from the center of the end cover 14. Two lateral ends of the column ring 13 are respectively provided with a through slot 131 so a pair of connecting sheets 31 of the sliding member 3 are able to protrude from the through slots 131, the length that the connecting sheet 31 protrudes out of the main body 1 is larger than the length of the power connecting electrode 21 so a protection function is provided. A left and a right sides of the main body 1 respectively has a hollow slot 15 so a pair of ground connecting electrodes 22 of the electrode connecting set 2 can be exposed. Each of the hollow slots 15 has an inner beveled surface 151 at its front end, so when each of the ground connecting electrodes 22 is compressed, a mobile end thereof is provided against the corresponding inner beveled surface 151.

The feature of the main body 1 of the present invention is that front ends opposite to the ends where the two hollow slots 15 are provided are oppositely installed with a pair of fastening sheets 16 in a vertical direction, an inner wall of a mobile end of each of the fastening sheets 16 is protrudingly provided with a bump 161. A top and a bottom surfaces of the rear portion of the main body 1 are oppositely provided with a pair of through holes 17, so linking sections 42 provided at a top and a bottom ends of the passive member 4 can protrude from the through holes 17. The rear portion of the main body 1 is further concavely provided with a pair of position limiting slots 18 for limiting an axial motion distance of the releasing ring 5. A resilient blocking sheet 181 is backwardly extended from each of the position limiting slots 18, so flanges 511 provided at a middle portion of the releasing ring 5 are able to be restrained from forwardly moving.

The electrode connecting set 2 is respectively installed with a resilient power connecting electrode 21 and two resilient ground connecting electrodes 22 at the axial and the radial directions of the main body 1, the connecting electrodes 21, 22 respectively protrude from the end cover 14 provided at the front end of the main body 1 and the hollow slots 15 provided at the two lateral ends of the main body 1, so when being plugged into an electricity acquiring socket, DC power is obtained through the connecting electrodes 21, 22. As shown in FIG. 1, a fuse 24 is installed between the power connecting electrode 21 and a metal intermediate member 23, e.g. a S-shaped resilient member, the intermediate member 23 is coupled to a guiding wire 251 of a power cable 25, and the two bow-shaped ground connecting electrode 22 are coupled to another guiding wire 252 through a connecting sheet 221 so as to be fastened in the main body 1.

For protecting the fuse 24, a tube 26 is provided for accommodating the fuse 24, so two ends of the fuse 24 are respectively in contact with the intermediate member 23 and the power connecting electrode 21; wherein a rear portion of the tube 26 is provided with a tube slot 261 for receiving the intermediate member 23, a front portion of the tube 26 is served to receive a first spring 27, one end of the first spring 27 is provided against a convex ring 262 provided at a middle portion of the tube 26.

The sliding member 3 is a tubular member and is provided at the front end of the tube 26 and is provided against the other end of the first spring 27, so the fuse 24 is able to pass through the sliding member 3 and be received in the tube 26. The sliding member 3 has a pair of arc-shaped connecting sheets 31 protruding from the through slots 131, and a pair of pushing rods 32 backwardly extended in a direction vertical to the connecting sheets 31, a beveled surface 321 is respectively provided at a rear portion of each of the pushing rods 32.

The passive member 4 is a solid object, e.g. a wedge member, a pair of connecting arms 41 are forwardly extended from the passive member 4, inner ends of the pair of connecting arms 41 are provided adjacent to the beveled surfaces 321 provided at the outer ends of the pushing rods 32, outer ends of the pair of connecting arms 41 are provided adjacent to the bumps 161 provided at the inner walls of the mobile ends of the fastening sheets 16. The linking sections 42 provided at the top and the bottom ends of the passive member 4 protrude from the through holes 17, so the passive member 4 is able to be synchronously moved with a backward movement of the releasing ring 5. For providing an auto recovering function to the passive member 4, the rear end of the passive member 4 is axially provided with a spring hole 43 for being connected to a second spring 44, the rear end of the second spring 44 is provided against a stopping sheet 19 installed inside the bottom cover 11.

The releasing ring 5 is received from the front end of the main body 1, so the two flanges 511, whose front ends are inwardly extended and provided at middle portions of concave slots 51 that are oppositely disposed, pass through the resilient blocking sheets 181 of the position limiting slots 18 provided at the rear portion of the main body 1, so as to form a situation that the flanges 511 and the resilient blocking sheets 181 are provided against each other. Inner ends of a step-shaped connecting ring 52 provided at an inner front portion of the releasing ring 5 are provided adjacent to the two linking sections 42 protruding from the through holes 17. For fastening the releasing ring 5 at the rear portion of the main body 1 and generating no rotation motion, plural elongated sliding slots 10 are concavely provided at the periphery of the main body 1, and the connecting ring 52 is protrudingly provided with convex buttons 521 with respect to the sliding slots 10, when being assembled, the convex buttons 521 are received in the corresponding sliding slots 10.

Figure 3:
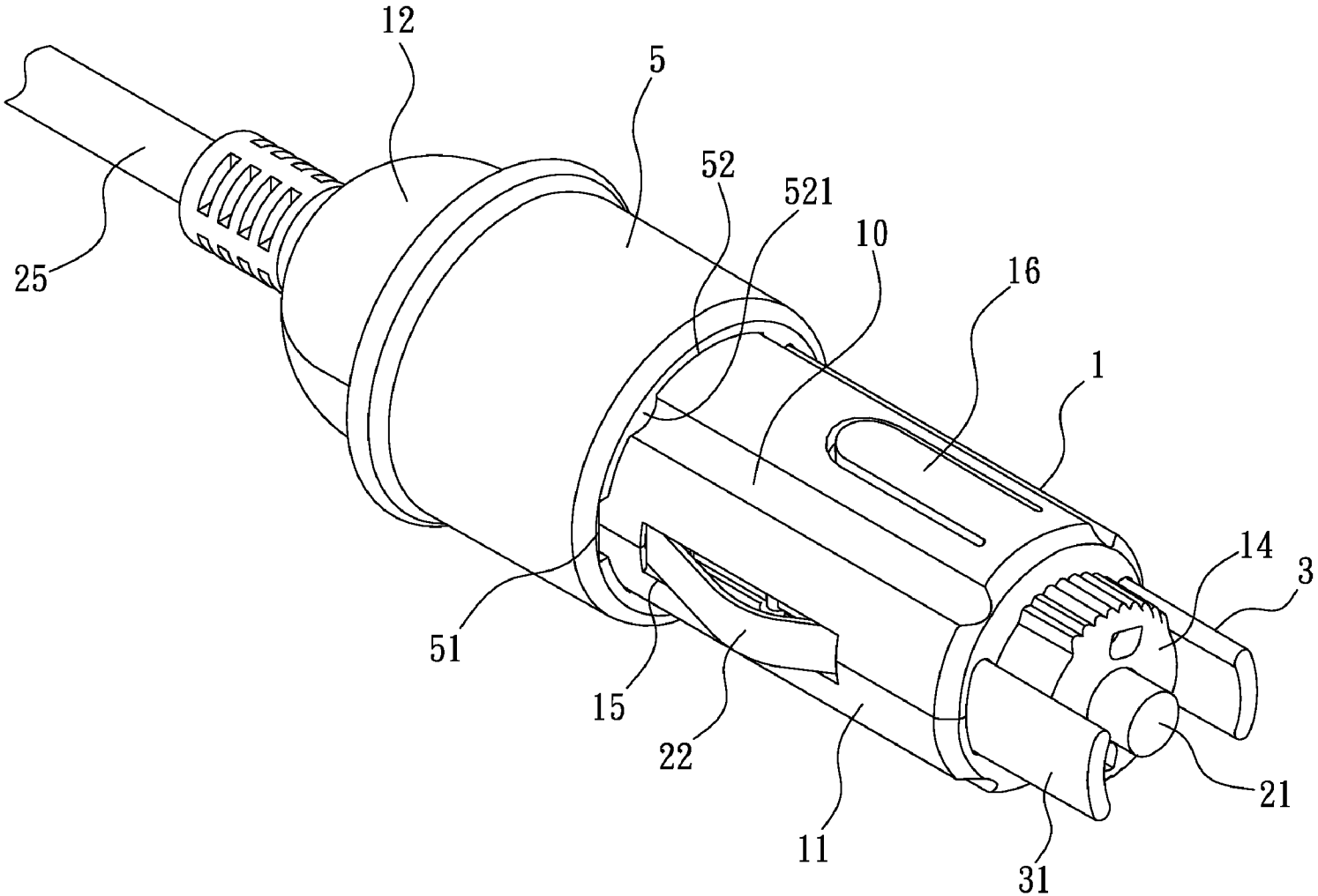
FIG. 3 is a 3D view illustrating the assembly of the present invention.
Figure 4A:
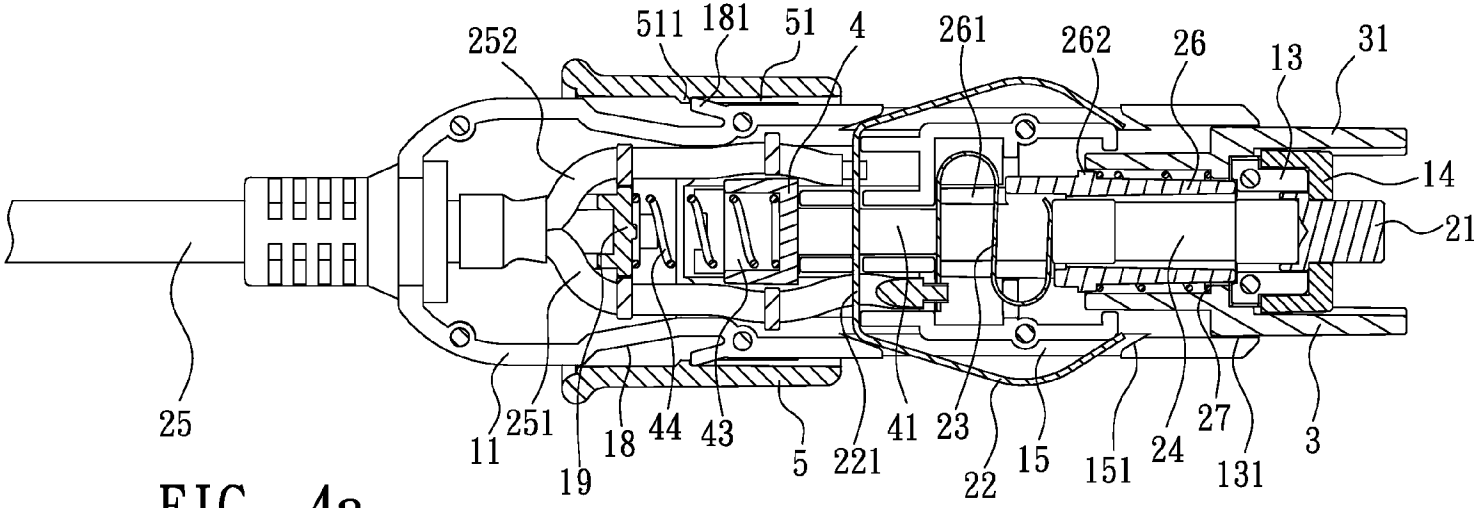
FIG. 4*a* and FIG. 4*b* are cross sectional views of the assembly of the present invention.
Figure 4B:
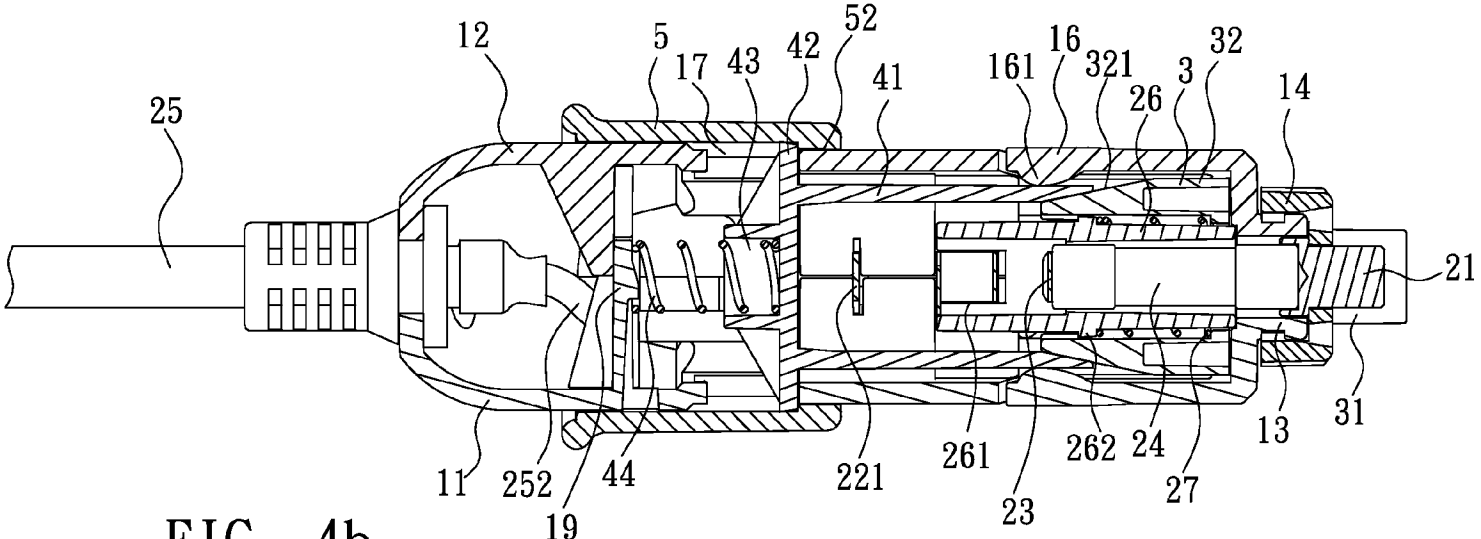

Referring from FIG. 1 to FIG. 4*b*, when the electricity acquiring plug for vehicle provided by the present invention is assembled, the two guiding wires 251, 252 of the power cable 25 are respectively welded on the intermediate member 23 and the ground connecting electrodes 22, then the tube 26, the first spring, 27 and the sliding member 3 are provided at the front end of the intermediate member 23, the passive member 4 is provided at the rear end of the ground connecting electrodes 22, so the two connecting arms 41 of the passive member 4 are provided adjacent to the beveled surfaces 321 provided on the outer ends of the two pushing rods 32 of the sliding member 3, then the above mentioned semi-finish product is disposed inside the bottom cover 11, then the second spring 44 is provided between the passive member 4 and the stopping sheet 19 provided at the rear portion of the bottom cover 11, and the top and the bottom covers 12, 11 are engaged; then the releasing ring 5 is sleeved in from the front end of the main body 1 and is positioned, lastly the fuse 24, the power connecting electrode 21 and the end cover 14 are disposed in the column ring 13 provided at the front end of the main body 1, the 3D view shown in FIG. 3 is therefore obtained, and relative components provided in the interior are illustrated in FIG. 4*a* and FIG. 4*b*.

Figure 5A:
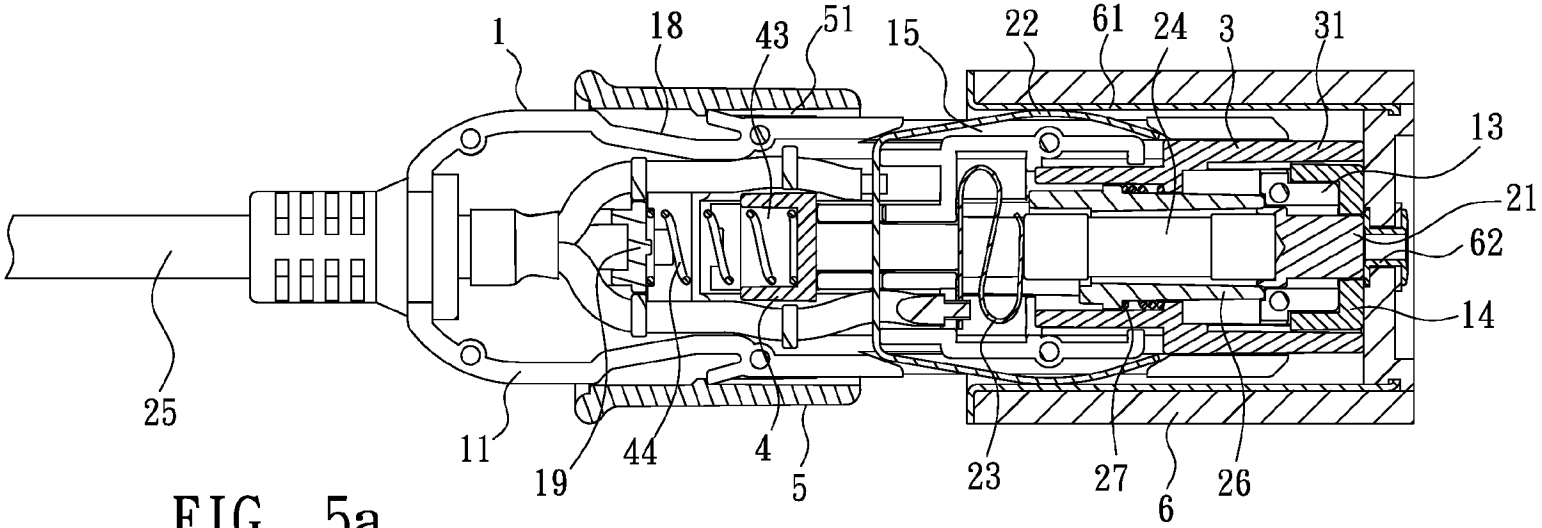
FIG. 5*a* and FIG. 5*b* are cross sectional views illustrating the electricity acquiring plug for vehicle being plugged into an electricity acquiring socket.
Figure 5B:
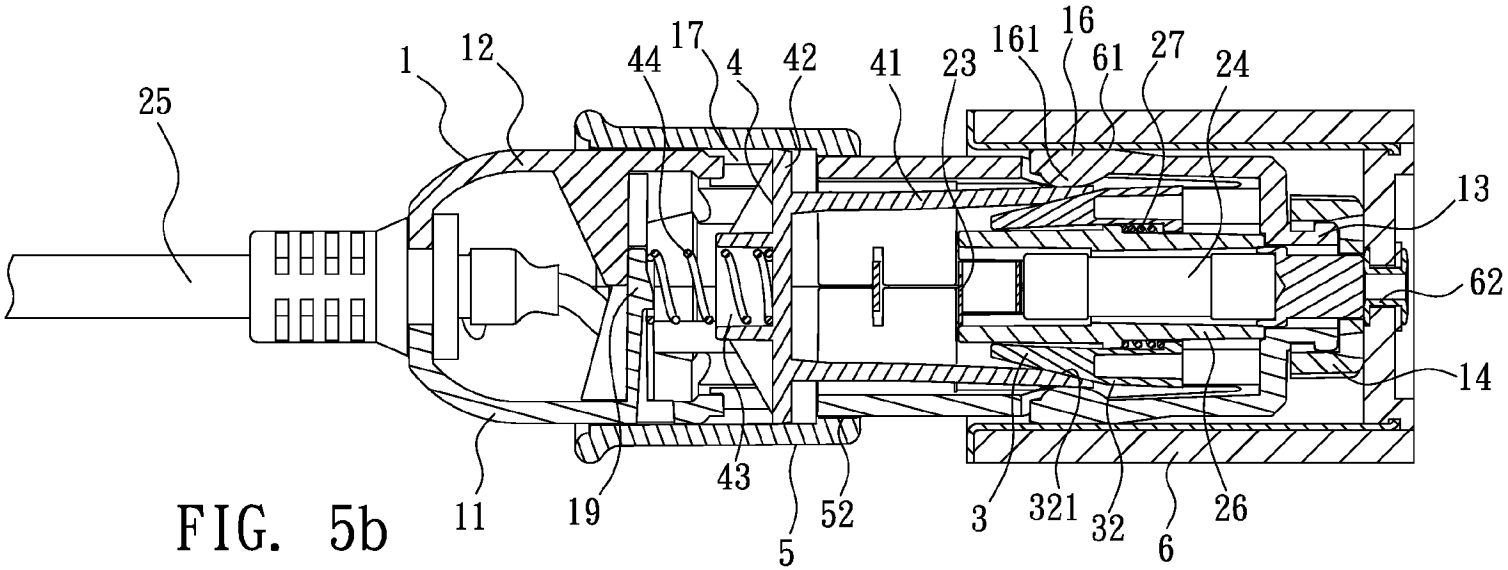

When the electricity acquiring plug for vehicle acquires power from an electricity acquiring socket, referring to FIG. 5*a* and FIG. 5*b*, the electricity acquiring plug for vehicle is plugged into the electricity acquiring socket 6, so the two ground connecting electrodes 22 are resiliently against connecting points 61 provided at the inner wall of the socket 6 so a grounding function is achieved, the pair of connecting sheets 31 provided at the front end of the sliding member 3 are firstly in contact with the inner front wall of the socket 6, still the main body 1 is inwardly pushed into the socket 6, after the power connecting electrode 21 is in contact with a connecting point 62 provided at the inner front wall of the socket 6, the power connecting electrode 21 and the sliding member 3 are synchronously backwardly moved so the intermediate member 23 and the first spring 27 are compressed, and the pair of connecting arms 41 of the passive member 4 are forced to outwardly protrude by the beveled surfaces 321 of the pair of pushing rods 32, so each of the bumps 161 provided at the inner walls of the free ends of the fastening sheets 16 of the main body 1 is protruded and outwardly expanded.

When the pair of fastening sheets 16 are outwardly expanded and in contact with the inner lateral wall of the socket 6, the fastening sheets 16 can no be further expanded but the sliding member 3 is still backwardly moved, so the pair of connecting arms 41 of the passive member 4 is also backwardly moved, at this moment, an auto fastening status is formed between the socket 6 and the main body 1 through the tension force of the second spring 44 and the beveled surfaces 321 of the pushing rods 32. The power connecting electrode 21 also has a proper connecting pressure due to the tension force of the intermediate member 23 so a larger current is able to pass through. So an electronic product can obtain power through the power cable 25 extended from the rear end of the main body 1.

Figure 6:
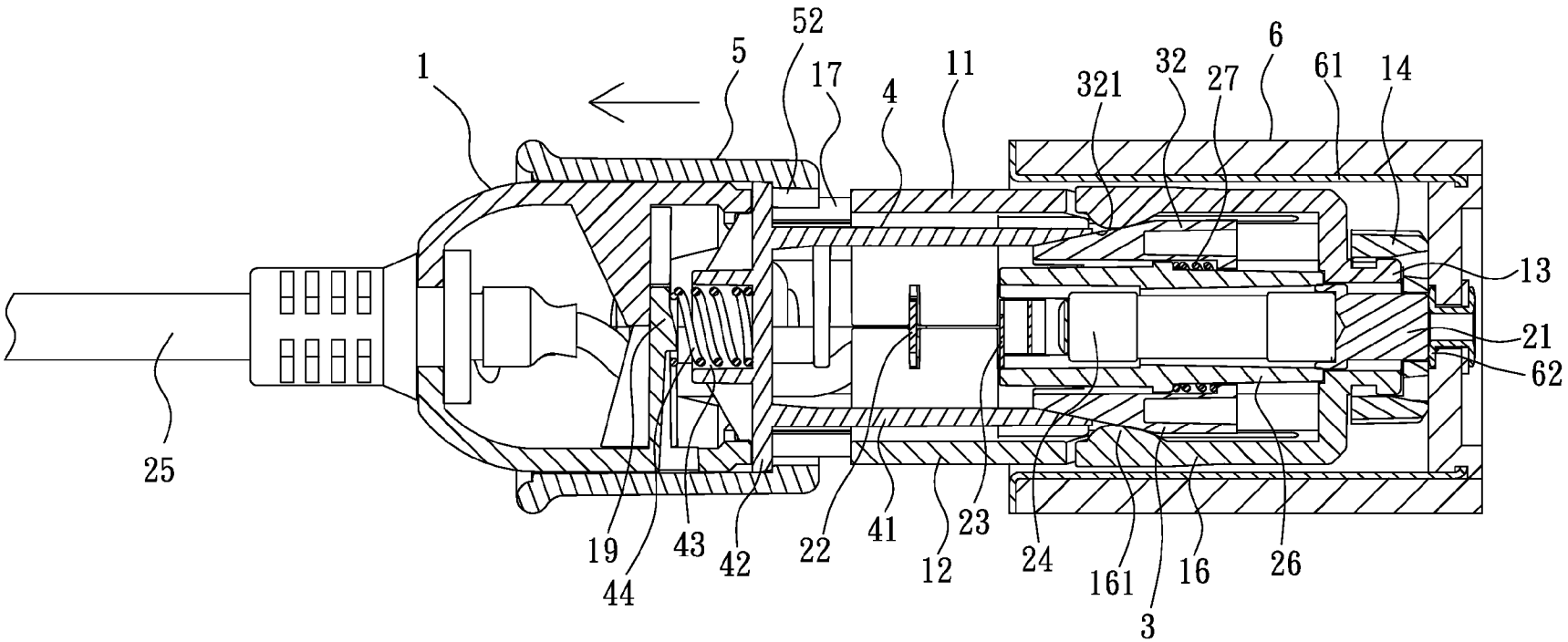
FIG. 6 is a cross sectional view illustrating the fastening status of the electricity acquiring plug for vehicle of the present invention being released.

As shown in FIG. 6, when the use of the electronic product is finished and the electricity acquiring plug for vehicle is desired to be released from the socket 6, the releasing ring 5 is backwardly pulled and the passive member 4 and the connecting arms 41 thereof are driven to synchronously and backwardly moved along the beveled surfaces 321 of the pushing rods 32, and the bumps 161 provided a the bottom ends of the two fastening sheets 16 are inwardly retracted so a fastening status is released, then the two ground connecting electrodes 22 are released from the inner lateral wall of the socket 6, and the main body 1 is still backwardly pulled, so the electricity acquiring plug for vehicle can be smoothly released from the electricity acquiring socket.

The advantages of the present invention are: through an operation of plugging the main body into the electricity acquiring socket, the sliding member and the passive member provided inside the main body are expanded in a radial direction, so the fastening sheets installed on the surface of the main body are outwardly expanded and against the inner lateral wall of the socket, a fastening status is therefore obtained and an auto fastening function is achieved, so the connection of the electricity acquiring plug for vehicle and the socket can be avoided from being overly tight or overly loose; through an operation on the releasing ring provided at the rear portion of the main body, the passive member can be backwardly moved and the pair of fastening sheets are no longer pressed then the fastening sheets are inwardly retracted so the fastening status is released, a rapid releasing function is therefore achieved.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electricity acquiring plug used in vehicle, comprising:

a hollow main body having an electrode connecting set installed inside therein and the electrode connecting set being installed with a power connecting electrode and two ground connecting electrodes respectively at a front end and two lateral ends of the main body, the power and the ground connecting electrodes being respectively coupled to guiding wires of a power cable, the power cable being extended from the rear end of the main body, wherein a pair of fastening sheets and at least one through hole being respectively provided to a front and a rear portions of the main body in a radial direction;

a sliding member, two connecting sheets and two pushing rods being respectively installed at a front and a rear ends of the sliding member, the pair of connecting sheets protruding from the front end of the main body, the power connecting electrode being disposed between the two connecting sheets, the two push rods being respectively provided with a beveled surface, and a first spring being installed between the sliding member and the interior of the main body;

a passive member, two connecting arms provided adjacent to the beveled surfaces at the outer ends of the pushing rods being extended from the front end of the passive member, and a free end of each of the connecting arms being provided adjacent to the fastening sheets, and at least one linking section protruding from the through hole being radially provided on the passive member, a second spring being installed between the passive member and the interior of the main body; and a releasing ring, provided at the rear portion of the main body, a connecting ring whose inner end adjacent to the linking section being protrudingly provided on the inner wall of the releasing ring;

when the two connecting sheets provided at the front end of the main body are inwardly retracted due to an external force, the beveled surfaces of the pair of pushing rods are inwardly moved and the pair of connecting arms of the passive member are outwardly expanded, so inner walls of the pair of fastening sheets of the main body are outwardly expanded through the pair of connecting arms, a fastening status is therefore obtained; when the releasing ring provided at the rear portion of the main body is backwardly pulled, the linking section of the passive member is pushed by the connecting ring of the releasing ring, so the passive member is backwardly moved, and the fastening sheets are no longer pressed and inwardly retracted so the fastening status is released.

2. The electricity acquiring plug used in vehicle as claimed in claim 1, wherein a bump is provided between an inner wall of a free end of the fastening sheet and an outer side of a free end of the connecting arm.

3. The electricity acquiring plug used in vehicle as claimed in claim 1, wherein the front end of the main body is further provided with a column ring connected to an end cover, and the power connecting electrode is protruded from the end cover; two lateral ends of the column ring are respectively provided with a through slot so the connecting sheets can protrude from the through slots, and the length of the pair of connecting sheets protruding from the main body is larger than the length of the power connecting electrode.

4. The electricity acquiring plug used in vehicle as claimed in claim 1, wherein the pair of ground connecting electrodes are respectively exposed outside a pair of hollow slots provided at a right and a left ends of the main body; wherein an inner beveled surface is provided at the front end of each of the hollow slots, when the pair of ground connecting electrodes are compressed, free ends thereof are provided against the inner beveled surfaces.

5. The electricity acquiring plug used in vehicle as claimed in claim 1, wherein the rear portion of the main body is further provided with a pair of concave position limiting slots, a resilient blocking sheet is backwardly extended from the front end of each of the position limiting slots; a concave slot is inwardly extended from the front end of the releasing ring with respect to the location of each of the position limiting slots, a flange provided at a middle portion of each of the concave slots passes through the resilient blocking sheet, so as to form a situation that the flange and the resilient blocking sheet are provided against each other.

6. The electricity acquiring plug used in vehicle as claimed in claim 1, wherein a plurality of elongated sliding slots are concavely provided at the periphery of the main body, and the connecting ring is protrudingly provided with convex buttons with respect to the positions of the sliding slots, the convex buttons are received in the corresponding sliding slots.

7. The electricity acquiring plug used in vehicle as claimed in claim 1, wherein further includes a tube, the tube is served to accommodate a fuse, a front portion thereof is served to receive the sliding member, and a first spring is installed in between; one end of the fuse is connected to the power connecting electrode and the other end thereof is connected to a metal intermediate member, the intermediate member is coupled to a guiding wire of a power cable, the two ground connecting electrodes are coupled to another guiding wire through a connecting sheet provided at the rear end of the ground connecting electrodes.

8. The electricity acquiring plug used in vehicle as claimed in claim 7, wherein the intermediate member is an S-shaped resilient member, a tube slot is provided at a rear portion of the tube for receiving the intermediate member.

9. The electricity acquiring plug used in vehicle as claimed in claim 1, wherein a spring hole is axially provided at the rear end of the passive member, a second spring is installed between the spring hole and a stopping sheet protrudingly provided inside the main body.

* * * * *